US006633510B1

(12) United States Patent
Hall

(10) Patent No.: US 6,633,510 B1
(45) Date of Patent: Oct. 14, 2003

(54) DUAL TIME ZONE TIME PIECE

(76) Inventor: Alfred E. Hall, 14943 Hillcrest Rd., Dallas, TX (US) 75248

( * ) Notice: Subject to any disclaimer, the term of this patent is extended or adjusted under 35 U.S.C. 154(b) by 0 days.

(21) Appl. No.: 09/707,623

(22) Filed: Nov. 7, 2000

(51) Int. Cl.[7] ..... G04B 19/00
(52) U.S. Cl. ..... 368/24; 368/223; 368/242
(58) Field of Search ..... 368/281, 276, 368/282, 10, 223, 21, 84

(56) References Cited

U.S. PATENT DOCUMENTS 4,222,227 A * 9/1980 Arabian
4,444,513 A * 4/1984 Proellochs
4,656,469 A * 4/1987 Oliver et al. ..... 340/802
5,487,053 A * 1/1996 Beiswenger et al. ..... 368/84
5,995,456 A * 11/1999 Brewer et al. ..... 368/242
6,414,910 B1 * 7/2002 Kaneko et al. ..... 368/242

FOREIGN PATENT DOCUMENTS

JP 63259490 A * 10/1988 ..... 368/21
JP 363259490 A * 10/1988 ..... 368/21

OTHER PUBLICATIONS

"The Voyager's Collection", pp 30 and Back Cover, at Least as Early as Oct., 2000.*

* cited by examiner

*Primary Examiner*—David Martin
*Assistant Examiner*—Jeanne-Marguerite Goodwin
(74) *Attorney, Agent, or Firm*—Alfred E. Hall

(57) ABSTRACT

A dual time piece having at least two clock faces thereon with each clock face having indicia thereon that enable the user to determine whether the time displayed by each time piece represents time before noon or time after noon.

4 Claims, 1 Drawing Sheet

DUAL TIME ZONE TIME PIECE

BACKGROUND OF THE INVENTION

1. Field of the Invention

The present invention relates to time pieces for keeping time in at least two separate time zones to enable the user thereof to see at a glance whether the time indicated by each time piece is in the morning before 12 noon or is in the afternoon after 12 noon.

2. Description of Related Art

Dual time pieces are well known in the art. They generally have, in one clock unit, two clock faces so that the dial on one face can be set to local time and the second dial on the second face can be set to a time in a different time zone. They can be mechanical watches or LCD watches.

The problem occurs when looking at the local time and then when looking at the time in the other time zone, telling whether it is in the morning or the afternoon. For instance, a traveler in Japan may set the local time to 12:00 noon while, at that same time in a location such as Dallas, Texas, the time may be 10:00 p.m. When looking at the two dials, one may wonder if the time in Dallas means 10:00 a.m. the next day or 10:00 p.m. the same day.

It would advantageous to have such a dual time watch that indicated on each dial face whether the time was in the afternoon or in the morning.

SUMMARY OF THE INVENTION

The present invention solves the problem of the prior art by having indicia related with each dial face that indicates whether the time indicated is A.M. or P.M. This can be accomplished with either a mechanical watch or a watch having an LCD face by placing indicia on the face that indicates whether the time indicated is in the a.m. or the p.m. The indicia could be a window in which the letters a.m. or p.m. appear. In an LCD display, the color of the LCD face representing p.m. time could change to a darker color. It is well known that certain LCD materials will change color from one to another upon application of a different voltage to the LCD material. In this manner, the user of the watch, when looking at the two faces, will know immediately whether each of the first and second time zones is in the a.m. or the p.m. Thus, if the user is in Japan and has set local Japanese time to 10:00 a.m. on one dial, it will have indicia representing a.m. hours (such as a window with a.m. in it or the color of the LCD being one color). If the other dial is set to 3:00 a.m. in some other time zone, that dial will have indicia on it also representing a.m. hours. Thus the user will know that when it is 10:00 a.m. where he/she is located, it is 3:00 a.m. at the other time zone. In like manner, if it is 10:00 a.m. local time in Tokyo and 3:00 p.m. in a second time zone, the user will be able to tell that the time in the second time zone is in the p.m. because of the indicia that shows, such a window with the proper time letters therein or because of the different color of one LCD face from the other.

Thus, it is an object of the present invention to provide a dual time piece that enables the user to tell when each time is in the a.m. or the p.m.

It is also an object of the present invention to provide indicia on the face of each time piece that provides a visual indication of a.m. or p.m. time.

It is still another object of the present invention to provide a dual time piece having a window in the face thereof in which a designation of morning or afternoon hours appear.

It is yet another object of the present invention to provide a dual time piece having LCD faces in which a face showing a.m. time is of one color and the face showing p.m. time is of another color.

Thus, the invention relates to an improved dual time piece having at least first and second time indicating units thereon for indicating time in at least first and second time zones, the improvement comprising indicia associated with each time indicating unit for providing a visual indication of whether that time indicating unit is indicating a.m. time or p.m. time.

The invention also relates to a method of telling time in two separate time zones comprising the steps of providing first and second time indicating faces; and locating indicia on each time face that shows whether the time indicated thereon is a.m. time or p.m. time.

BRIEF DESCRIPTION OF THE DRAWINGS

These and other more detailed objects of the present invention will be disclosed when taken in conjunction with the following detailed description of the drawings in which like numerals represent like elements and in which.

DETAILED DESCRIPTION OF THE DRAWINGS

Figure 1:
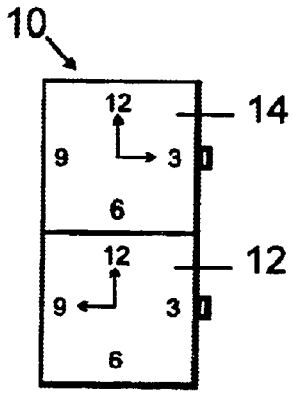
FIG. 1 is a diagrammatic representation of a dual time piece where each watch is set to a different time but with no indication of whether the time is in the a.m. or the p.m.

FIG. 1 is a diagrammatic representation of a prior art dual time piece 10 having a first watch face 12 and a second watch face 14. Watch face 12 is set with the hour hands at 9:00 o'clock while watch face 14 is set with the hour hands at 3:00 o'clock. Assume that the hands on the face 12 are set to a local time of 9:00 a.m. and that hands on the face 14 are set to some different time zone. Of course, since the hands on face 12 are set at local time, the user knows that the indicated local time is a.m. The problem illustrated is that the user does not know whether the hour hands on face 14 are a.m. or p.m. The user can, of course, calculate the difference in hours between the two time zones and in which direction, east or west, the second time zone is located and thus determine whether the second time zone is in the a.m. or p.m. However, there is no clear cut instantaneous indication of what time of day is represented by the second watch face 14.

Figure 2:
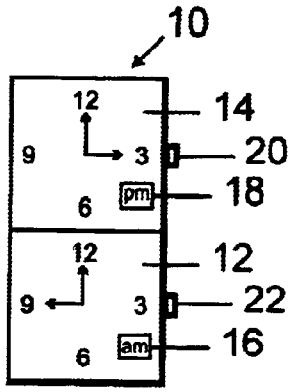
FIG. 2 is a diagrammatic representation of a dual time piece where each watch is set to a different time zone but each watch face has a window therein wherein the letters a.m. and p.m. are visible.

FIG. 2 is a diagrammatic representation of a first embodiment of the present invention in which a dual time piece 10 again has a first watch face 12 with the hour hands set to 9:00 o'clock and the second watch face 14 has the hour hands set to 3:00 o'clock. Watch face 12 has a window 16 therein with the letters "a.m." exposed. In like manner, watch face 14 has a window 18 therein with the letters "p.m." exposed therein. Thus, the user knows immediately that the time in the second time zone is 3:00 p.m. Conventional control stems 20 and 22 can be provided for setting both the time and a.m./p.m. designations in a conventional manner.

Figure 3:
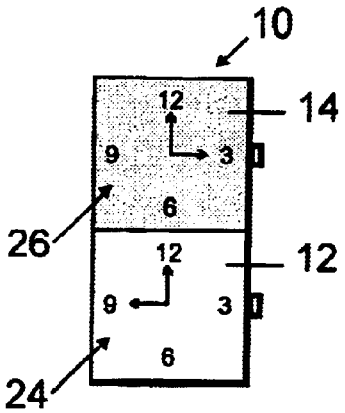
FIG. 3 is a diagrammatic representation of a dual time piece where each watch is set to a different time zone and each watch has an LCD face and wherein one face is of a different color than the face of the other LCD face to distinguish a.m. hours from p.m. hours.

FIG. 3 is a diagrammatic representation of a second embodiment of the present invention wherein the dual time piece 10 is comprised of two LCD watches 12 and 14. In this case, the LCD face 26 of the second time piece 14 is of a different color than the LCD face 24 of the first time piece 12 thus indicating that the time represented by the hour hands of the second time piece 14 is in the p.m. When both watch faces represent a.m., they will both be of the same first color. When both watch faces represent p.m., they will both be of the same different color. Again, the user will be able to tell whether the time indicated by the second time piece is in the a.m. or the p.m. simply by looking at the face of the dials of the timepieces 12 and 14.

Figure 4:
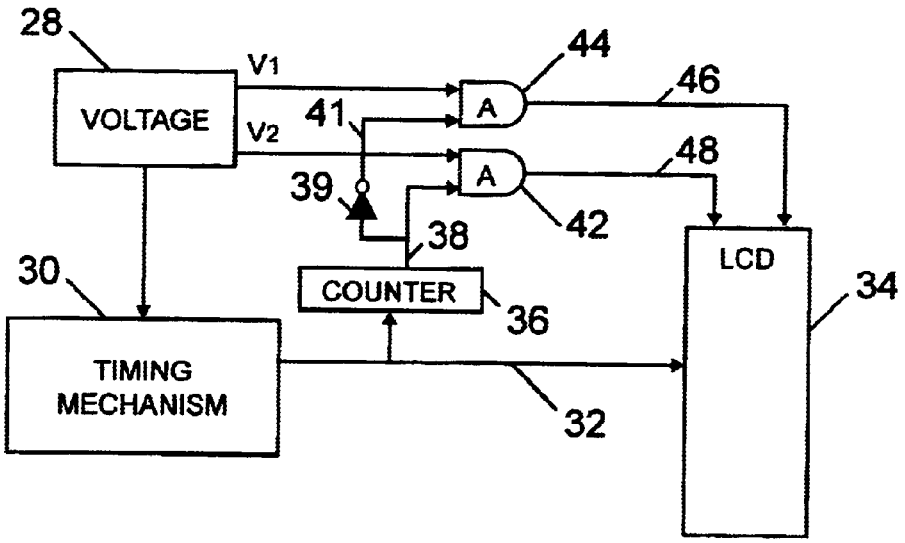
FIG. 4 is a diagrammatic representation of a simple circuit for changing the voltage to the LCD clock face to change its color at 12:00 noon.

A simple circuit for changing the voltage applied to the LCD is shown in FIG. 4. A voltage source 28 powers a timing mechanism 30, of any well known type, to cause it to provide an output on line 32 that enables the proper time to be shown on the LCD display 34. A counter 36 generates an output on line 38 when a count of 12, representing 12 noon, is received. Prior to the count of 12 being received, there is no output on line 38 and inverter 39 causes an output on line 41 to enable AND gate 44 thereby enabling a first voltage, $V_1$, from the power source 28 to be coupled to the LCD display 34 on line 46. This voltage causes the LCD watch face to have a first color. When a count of 12 is received, inverter 39 removes the output signal from line 41 thereby disabling AND gate 44 and removing voltage, $V_1$, from line 46 to the LCD display 34. However, the output from counter 36 on line 38 enables AND gate 42 thereby providing a second different voltage, $V_2$, to be applied to LCD display 34 on line 48 thereby changing the color of the LCD watch face in a well known fashion.

The present invention also relates to a method for improving a dual time piece by providing indicia related to each time piece that gives an indication of whether the time in the time zone represented by each time piece is in the a.m. or p.m. The indicia may be either a window in the face of each time piece in which the letters a.m. or p.m. appear appropriately or, in an LCD dual time piece, the face of one LCD can change in color when the time goes from a.m. to p.m. LCD materials that change color with a change in applied voltage are well known in the art and will not be discussed herein.

Thus, there has been disclosed a novel dual time piece in which the user, simply by looking at the face of each time piece can tell whether the time indicated is in the a.m. or p.m. Indicia can be placed on the face of each time piece to represent a.m. or p.m. simply by looking at the time piece face. The indicia could be, for example only, a window in the face of each time piece in which the appropriate letters "a.m." or "p.m." appear or the face of an LCD time piece could be caused to change from one color representing "a.m." to another color representing "p.m.".

What is claimed is:

1. An improved dual time zone time piece having first and second LCD clock faces formed of liquid crystal and representing two time zones, the improvement comprising:

electronic means coupled to said liquid crystal forming each of said first and second LCD clock faces for automatically causing said liquid crystal forming each of said first and second LCD clock faces to have only one first color before 12:00 noon and after 12:00 midnight thus representing only a.m. hours; and said electronic means automatically causing said liquid crystal forming each of said first and second LCD clock faces to have only one second color after 12:00 noon and before 12:00 midnight thus representing only p.m. hours to thereby readily indicate a.m. or p.m. hours to a user of said dual time zone time piece.

2. The dual time zone time piece of claim 1 wherein said electronic means comprises:

a timing circuit for generating signals that cause each of said first and second LCD clock faces to indicate a.m. and p.m. time;

a power source coupled to said timing circuit and to said liquid crystal forming each of said first and second LCD clock faces so as to provide a first voltage to either of said first and second LCD clock faces only when the associated time piece represents a.m. hours thereby causing either of said first and second LCD clock faces to have only said one first color during the a.m. hours; and said power source providing a second different voltage to either of said first and second LCD clock faces only when the associated timepiece represents p.m. hours thereby causing either of said first and second LCD clock faces have only said one second color during the p.m. hours thereby readily indicating a.m. hours and p.m. hours to a user thereof.

3. A method for improving a dual time zone timepiece having first and second timepieces with first and second corresponding LCD clock faces formed of liquid crystal, each timepiece representing one of two time zones, the method comprising the steps of:

automatically causing the liquid crystal of the LCD clock face of each of first and second timepieces to have only one first color when either of said first and second time pieces represents a.m. hours; and automatically causing the liquid crystal of the LCD clock face of each of first and second timepieces to have only one second color when either of said first and second time pieces represents p.m. hours thus enabling a.m. hours and p.m. hours to be readily distinguished from each other.

4. The method of claim 3 wherein the steps of causing said liquid crystal forming said first and second LCD clock faces to have said only one first color when either of said first and second time pieces is representing a.m. hours and said only one second color when either of said first and second time pieces is representing p.m. hours further comprises the steps of:

providing a timing circuit for generating a.m. and p.m. time signals;

coupling a first voltage to said liquid crystal forming each of said first and second clock faces to cause the liquid crystal forming each of said first and second LCD clock faces to have only said first color only when said timing circuit provides said a.m. time signals to respective ones of said time pieces during the hours before 12:00 noon and after 12:00 midnight; and coupling a second different voltage to said liquid crystal forming each of said first and second LCD clock faces to cause said liquid crystal forming each of the first and second LCD clock faces to have only said second color only when said timing circuit provides said p.m. time signals to respective one of said first and second time pieces during the hours after 12:00 noon and before 12:00 midnight.

* * * * *